United States Patent [19]

Aldinger, deceased et al.

[11] 3,982,855

[45] Sept. 28, 1976

[54] RADIAL PISTON PUMP

[75] Inventors: Ulrich Aldinger, deceased, late of Stuttgart, Germany, by Ruth Aldinger, heir, Stuttgart, Germany; by Karl Aldinger, heir, Stuttgart, Germany

[73] Assignee: Robert Bosch G.m.b.H., Stuttgart, Germany

[22] Filed: May 22, 1975

[21] Appl. No.: 579,818

[30] Foreign Application Priority Data

May 24, 1974 Germany ..... 2425022

[52] U.S. Cl. ..... 417/270; 417/295

[51] Int. Cl.[2] ..... F04B 1/04; F04B 49/00

[58] Field of Search ..... 417/270, 295, 307

[56] References Cited

UNITED STATES PATENTS

| | | | |
|---|---|---|---|
| 2,916,999 | 12/1959 | Christenson | 417/295 |
| 3,418,937 | 12/1968 | Cardillo et al. | 417/275 |
| 3,434,428 | 3/1969 | Liles | 417/270 |

FOREIGN PATENTS OR APPLICATIONS

| | | | |
|---|---|---|---|
| 1,453,478 | 2/1969 | Germany | 417/270 |

*Primary Examiner*—William L. Freeh
*Assistant Examiner*—G. P. LaPointe
*Attorney, Agent, or Firm*—Michael J. Striker

[57] ABSTRACT

A radial piston pump wherein the drive shaft for the pistons in radially extending cylinders of the housing has an eccentric which moves the pistons outwardly against the opposition of springs. The inlet port of the housing communicates with the cylinders by way of a first passage which contains a reciprocable valve member and can discharge fluid directly into one of the cylinders. The other cylinders receive fluid from the first passage by way of an annular space which surrounds or is adjacent to the inner end of the shaft and bores which are machined in the housing to connect the annular space with the other cylinders. The outlet port of the housing can receive pressurized fluid from the cylinders by way of check valves. The valve member is biased by a spring to normally assume a first position in which it allows fluid to flow from the inlet port to the cylinders as long as the pressure at the outlet port is within a first range of pressures. When the pressure of fluid exceeds such first range, pressurized fluid acts against that end of the valve member which is remote from the valve spring whereby the valve member assumes a second position in which the cylinders are sealed from the inlet port. If the pressure at the outlet port rises still further, the valve member assumes a third position in which the outlet port is in direct communication with the inlet port so that the valve member acts not unlike a safety or pressure relief valve.

12 Claims, 3 Drawing Figures

RADIAL PISTON PUMP

BACKGROUND OF THE INVENTION

The present invention relates to pumps in general, and more particularly to improvements in hydraulic pumps wherein one or more pistons are movable in discrete cylinders of the pump housing to thereby effect the flow of fluid from an inlet port to an outlet port with simultaneous pressurization of the fluid.

It is known to provide the housing of a radial piston pump with several cylinders for discrete pistons which are reciprocable by a rotary member to thereby draw fluid from the inlet port and to pressurize the fluid on its way to the outlet port. As a rule, the pump comprises check valves which are interposed between the cylinders and the outlet port to prevent return flow of pressurized fluid into the cylinders. It is also known to install in such pumps a plurality of valves each of which acts not unlike a flow restrictor and automatically seals the inlet port from the respective cylinder when the pressure of fluid at the outlet port rises to a predetermined value. A drawback of such pumps is that they must be equipped with several flow restrictors which contribute to the initial and maintenance cost of the machine. Moreover, the body of the pump must be formed with an intricate network of channels, bores and similar passages for pressurized fluid in order to enable the valves to react in response to increasing fluid pressure at the outlet port. Still further, such pumps are often associateed or provided with discrete pressure relief valves which prevent excessive rise of fluid pressure at the outlet port. Such pressure relief valves also contribute to the initial and maintenance cost of the pumps.

SUMMARY OF THE INVENTION

An object of the invention is to provide a novel and improved pump wherein a single valve suffices to insure the termination of fluid inflow from the inlet port to the cylinder or cylinders when the pressure of fluid at the outlet port reaches a preselected value and wherein such valve also prevents the fluid pressure at the outlet port from reaching or exceeding a value which would be hazardous to the pump, to attendants and/or to the machines which receive pressurized fluid from the pump.

Another object of the invention is to provide a multiple-piston pump with a simple housing which need not be formed with a complex system of passages for the flow of fluid and which can insure uniform distribution of fluid to all of the cylinders.

A further object of the invention is to provide a radial pump wherein a single valve suffices to act as a safety valve as well as a means for automatically sealing the cylinders from the fluid-admitting port when the pressure of fluid at the outlet port rises to a preselected value.

The invention is embodied in a hydraulic pump, particularly in a radial piston pump, which comprises a housing having at least one cylinder, a fluid-admitting first port or suction port, a first passage (e.g., including a system of bores machined into the housing) connecting the cylinder with the first port and a second port which serves to discharge pressurized fluid and is communicatively connected with the cylinder (preferably through the medium of a check valve which does not permit pressurized fluid to flow from the second port into the cylinder), a piston which is reciprocable or otherwise movable in the cylinder to thereby draw fluid from the first port by way of the first passage and to force pressurized fluid into the second port, a rotary shaft or analogous means for moving the piston in the cylinder, and valve means movably installed in the first passage for movement between first, second and third positions. The housing is further formed with a second passage (e.g., a single channel) which connects and second port with a portion of the first passage so that the pressurized fluid in the second port and second passage can act upon the valve means to move the latter from the first position in which the valve means permits fluid to flow from the first port into the cylinder by way of the first passage but not from the second passage into the first passage while the pressure of fluid in the second port is within a relatively low first range. The thus displaced valve means then moves to a second position in which the valve means seals the first port from the cylinder while the pressure of fluid in the second port is within a higher second range. If the pressure of fluid in the second port exceeds the second range, the valve means is moved to the third position in which the second port can communicate with the first port by way of the second and first passage so that highly pressurized fluid can flow into tank or an analogous source of fluid which is connected with the first port. The valve means preferably comprises a reciprocable valve member one end of which is acted upon by a resilient element tending to maintain the valve member in the first portion and the other end of which is acted upon by pressurized fluid in the second passage.

The novel features which are considered as characteristic of the invention are set forth in particular in the appended claims. The improved pump itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
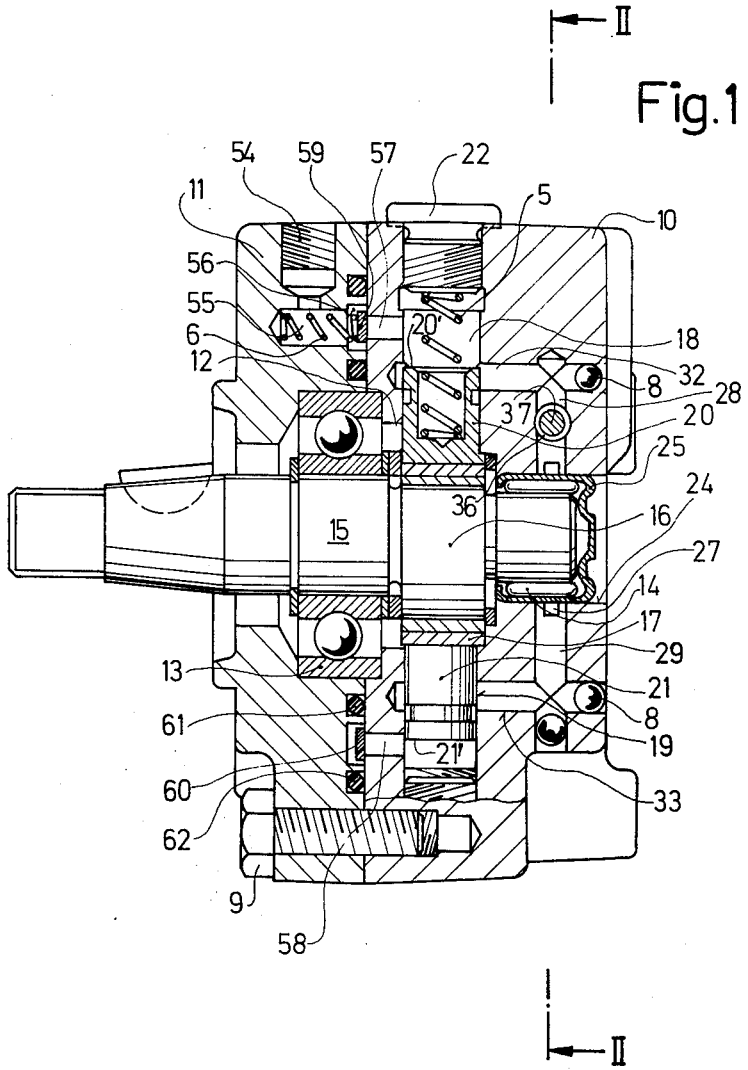
FIG. 1 is an axial sectional view of a radial piston pump which embodies one form of the invention.
Figure 2:
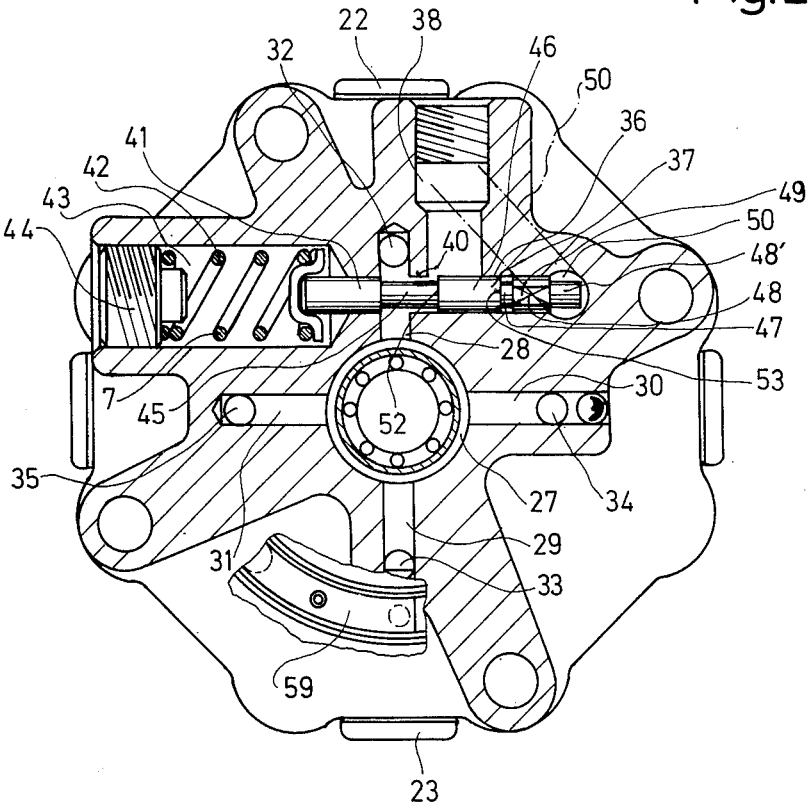
FIG. 2 is a sectional view as seen in the direction of arrows from the line II—II of FIG. 1.

Referring to FIGS. 1 and 2, there is shown a radial piston pump having a housing or body including main housing section 10 and a removable second section or cover 11 sealingly secured to one end of the main section 10 by bolts 9 or analogous fasteners. The housing 10, 11 has a centrally located bore 12 for an antifriction ball bearing 13 and an antifriction roller bearing 14. These bearings surround a drive shaft 15 having an eccentric portion 16 disposed between the bearings in line with four radially extending cylinders in the main housing section 10. FIG. 1 shows two of these cylinders at 18 and 19. The eccentric portion 16 of the shaft 15 is surrounded by a cylindrical sleeve 17 which is rotatable on the portion 16 and is contacted by the inner end faces of four pistons which are reciprocable in the respective cylinders in response to rotation of the shaft 15. The pistons in the bores 18, 19 of FIG. 1 are numbered 20 and 21. The four pistons are equally spaced from each other, as considered in the circumferential direction of the shaft 15. The outer ends of the cylinders are sealed by threaded plugs including those shown at 22 and 23.

The bore 12 communicates with a coaxial bore 24 which is machined into the section 10 and constitutes an extension of the bore 12. The bore 24 receives the antifriction roller bearing 14 and its outer end is sealed by a cupped metallic sealing element 25 which extends inwardly close to the eccentric shaft portion 16 so that it confines the bearing 14.

The main housing section 10 is further formed with an annular recess or space 27 which surrounds a median portion of the sealing element 25, i.e., the latter seals the radially innermost portion of the recess 27 from the bore 24 and hence from the bearing 14. The recess 27 communicates with radially outwardly extending blind bores 28, 29, 30 and 31 each of which is parallel with but spaced from one of the cylinders in the main housing section 10. The outer end portions of the blind bores 28–31 communicate wth transverse bores which are parallel to the axis of the shaft 15 and each of which further communicates with one of the cylinders in the main housing section 10. The transverse bores which connect the blind bores 28, 29 of FIG. 1 with the respective cylinders 18, 19 are shown at 32 and 33. The other two transverse bores are shown in FIG. 2, as at 34 and 35. The outer ends of the transverse bores 32–35 terminate in the right-hand end face of the main housing section 10, as viewed in FIG. 1, and are sealed by spherical sealing elements 8. These spherical elements are a press-fit in the housing section 10.

The blind bore 28 which is associated with the cylinder 18 is traversed by a cylindrical bore 36 for a reciprocable valve member 37. As shown in FIG. 2, the bore 36 for the valve member 37 is parallel to the blind bores 30, 31 and its diameter equals or closely approximates the diameters of certain portions of the valve member 37 so that the latter is slidable therein with a minimum of clearance. The bore 36 communicates with a low-pressure inlet or suction port 38 of the main housing section 10. The port 38 extends at right angles to the bore 36 and is connected with a tank or another suitable source of hydraulic fluid by a conduit, not shown. That portion of the bore 36 which connects the inner end portion of the suction port 38 with the blind bore 28 is shown at 40.

The valve member 37 comprises a plunger-like end portion or land 41 which engages a retainer 7 for a helical valve spring 42. This spring is mounted in a bore 43 of the main housing section 10 and reacts against a sealing plug 44 having threads mating with internal threads machined into the section 10 at the outer end of the bore 43. The spring 42 tends to maintain the valve member 37 in a first or right-hand end position, as viewed in FIG. 2, in which a smaller-diameter portion 45 of the valve member 37 allows fluid to flow between the suction port 38 and blind bore 28 (by way of the portion 40 of the bore 36). The smaller-diameter portion 45 of the valve member 37 is located between the land 41 and a similar land or plunger 46. The diameters of the lands 41, 46 are preferably identical. The land 46 is disposed between the smaller-diameter portion 45 and a relatively short second smaller-diameter portion 47 of the valve member 37, and the portion 47 is followed by a plunger or land 48 having two flats 49 extending in parallelism with the axis of the valve member 37. The land 48 is followed by a third smaller-diameter portion 48′ which constitutes the right-hand end portion of the valve member 37, as viewed in FIG. 2, and extends into a channel or passage 50 of the main housing section 10. The land 46 has two annular shoulders 52 and 53 which respectively face the portion 40 of the bore 36 and the passage 50.

The passage 50 communicates with a second port 54 which serves to supply pressurized fluid to a conduit (not shown) connected to a consumer, e.g., to a cylinder and piston unit or to another hydraulic motor. The port 54 further communicates with a transverse bore 55 which, in turn, communicates with an annular space 56 machined into that end face of the cover 11 which abuts against the main housing section 10. The annular space 56 communicates with the outer portions of cylinders in the main housing section 10 by way of bores including a bore 57 for the cylinder 18 and a bore 58 for the cylinder 19. The space 56 communicates with each of the four cylinders. The left-hand ends of the bores 57, 58 (and of the other two bores), as viewed in FIG. 1, contain tongue-like one-way check valves (shown at 59, 60) which prevent the flow of pressurized fluid from the port 54 back into the cylinders. The check valves do not appreciably interfere with the flow of pressurized fluid from the cylinders into the annular space 56 and thence into the port 54. If desired, the tongue-like check valves may be replaced by other types of check valves, and each thereof may further include a resilient element 6 which yieldably opposes the movement of the respective tongue in a direction to allow fluid to flow from the cylinders into the space 56.

The space 56 is disposed between two sealing rings 61, 62 which are recessed into the inner end face of the cover 11. These sealing rings prevent leakage of pressurized fluid outwardly and/or inwardly between the abutting faces of the main housing section 10 and cover 11.

When the piston 20 assumes its inner end position (nearest to the axis of the shaft 15), its outer end face 20′ allows fluid to flow from the transverse bore 32 into the cylinder 18. Analogously, when the piston 21 assumes its inner end portion, the outer end face 21′ of this piston allows fluid to enter the cylinder 19 via transverse bore 33. The outer end portions of the cylinders contain suitable springs which urge the inner end faces of the respective pistons against the peripheral surface of the eccentric portion 16 on drive shaft 15. A helical spring which reacts against the plug 22 and biases the piston 20 radially inwardly is shown at 5.

When the shaft 15 is driven by an electric motor or another suitable prime mover, and the piston 20 reaches its inner end position (shown in FIG. 1), the transverse bore 32 admits fluid into the outer portion of the cylinder 18. The transverse bore 32 receives fluid from the suction port 38 via bore 36 for the valve member 37 and blind bore 28. The bores 36, 28, 32 constitute a passage which connects the port 38 with the cylinder 18, and this passage contains the valve member 37. As mentioned above, the outer end face 20′ of the piston 20 allows fluid to flow from the bore 32 into the cylinder 18 when the piston 20 reaches or is close to its inner end position. As long as the pressure of fluid at the outlet port 54 (and hence also in the passage 50) is relatively low, the spring 42 maintains the valve member 37 in the first end position of FIG. 2 in which the smaller-diameter portion 45 of the valve member 37 allows fluid to flow from the port 38, via bore portion 40 and into the blind bore 28. The shoulder 52 of the land 46 is then remote from the bore portion 40. The eccentric portion 16 of the shaft 15 thereupon moves the piston 20 radially outwardly (i.e., toward the outer end position corresponding to that of the piston 21 in FIG. 1) wherèby the end face 20' moves outwardly and beyond the transverse bore 32 so that the cylinder 18 is temporarily sealed from the suction port 38. As the piston 20 continues to move radially outwardly, it pressurizes the fluid in the outer portion of the cylinder 18 and causes such fluid to flow into the port 54 via bore 57, check valve 59 in the annular space 58 and transverse bore 56 in the cover 11.

The piston 20 thereupon begins to move radially inwardly under the action of the helical spring 5. The check valve 59 closes to prevent return flow of pressurized fluid from the port 54 into the cylinder 18. The pressure in the outer portion of the cylinder 18 drops so that the piston 20 sucks fluid from the port 38 as soon as the outer end face 20' of the piston 20 allows fluid to flow from the transverse bore 32 into the cylinder 18. The cross-sectional areas of bores constituting the passage which supplied fluid to the cylinder 18 can be selected in such a way that the outer portion of the cylinder 18 is only partially filled with fluid during inward movement of the piston 20 when the shaft 15 is rotated at a high speed.

When the pressure of fluid in the port 54 (and hence also in the passage 50) rises beyond a first range of pressures, the pressurized fluid acts upon the end face of the end portion 48' and upon the adjacent shoulder of the land 48 of the valve member 37 whereby the latter moves in a direction to the left, as viewed in FIG. 2, the stresses the spring 42. The shoulder 52 reaches the bore portion 40 and seals the suction port 38 from the blind bore 28 when the fluid pressure in the port 54 and channel 50 rises to the lower limit of a second range of pressures. This terminates the admission of non-pressurized fluid to all four cylinders in the main housing action 10 (note that the blind bore 28 communicates wtih a third passage including the annular recess 27 and the blind bores 29–31). Consequently, the pressure of fluid in the port 54 normally cannot rise beyond that pressure which is necessary to effect a movement of the valve member 37 against the opposition of the spring 42 to that (second) position in which the shoulder 52 prevents the flow of fluid from the port 38 into the blind bore 28 and hence into the other three blind bores 29–31. However, it can happen that the pressure of fluid at the outlet port 54 rises beyond that range of pressures which are needed to effect the sealing of blind bore 28 from the suction port 38. This can happen if the fluid is permitted to leak from the port 38 into the bore 28 after the shoulder 52 reaches the respective end of the bore portion 40 or when the consumer (which is connected to the port 54) receives pressurized fluid from another pump or form an accumulator. The pressure of fluid in the port 54 and passage 50 then continues to rise and ultimately reaches a value at which the spring 42 undergoes additional deformation because the valve member 37 is pushed further in a direction to the left, as viewed in FIG. 2 (third position of the valve member). The shoulder 53 of the land 46 then moves into the inner portion of the port 38 and allows this port to communicate with the passage 50 and port 54 along the path including the space surrounding the smaller-diameter portion 47 of the valve member 37 and the spaces adjacent to the flats 49 on the land 48. Thus, the valve including the valve member 37 then performs the function of a pressure relief valve or safety valve by allowing fluid to flow directly from the high-pressure port 54 to the low-pressure port 38. Such versatility of the valve is desirable because the pump can operate properly at excessive pressures in the outlet port even though it does not embody a discrete safety valve.

The annular recess 27 constitutes a manifold or distributor space which supplies fluid to the blind bores 29–31. As mentioned above, the recess 27 receives fluid from the suction port 38 via bore 28 and bore portion 40 when the latter is not sealed by the shoulder 52 on the land 46 of the valve member 37. The recess 27 actually constitutes a radially outwardly extending portion of the bore 24 in the main housing section 10, and the bore 24 can be said to constitute an extension of the bore 12 for the drive shaft 15.

Figure 3:
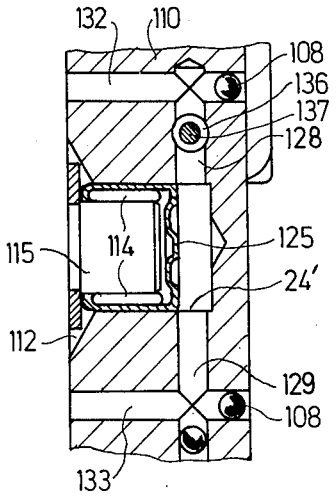
FIG. 3 is a fragmentary axial sectional view of a slightly modified radial piston pump.

FIG. 3 illustrates a slight modification of the main housing section. This section, denoted by the reference character 110, has a blind bore 112 corresponding to the bore 12 of FIG. 1 and including an innermost portion 24' which constitutes an equivalent of the bore 24 as well as of the annular recess 27 of FIG. 1. The blind bores 128, 129 (and the other two blind bores) communicate directly with the innermost portion 24' of the bore 112. FIG. 3 further shows the transverse bores 132, 133, the bore 136, the valve member 137, spherical sealing elements 108, the cupped sealing element 125, a portion of the drive shaft 115 and the antifriction roller bearing 114.

Without further analysis, foregoing will so fully reveal the gist of the present invention that others can, by applying current knowledge, readily adapt it for various applications without omitting features which fairly constitute essential characteristics of the generic and specific aspects of the above described contribution to the art and, therefore, such adaptations should and are intended to be comprehended within the meaning and range of equivalence of the claims.

What is claimed as new and desired to be protected by Letters Patent is set forth in the appended claims.

It is claimed:

1. In a pump, particularly in a radial pump, a combination comprising a housing having one cylinder and at least one additional cylinder, a fluid-admitting first port, a first passage connecting said cylinder with said first port and a second port arranged to discharge pressurized fluid and communicatively connected with said cylinders, a piston movable in said one cylinder to thereby draw fluid from said first port via said first passage and to force pressurized fluid into said second port, said housing further having a third passage adapted to connect said first port with said additional cylinder by way of said first passage, said third passage including a distributor space adapted to surround a bearing means and also including a first bore connecting said additional cylinder with said distributor space, said first passage having a second bore for said valve means and a third bore connecting said second bore with said distributor space to supply to said space fluid from said first port in said first position of said valve means, and an additional piston movable in said additional cylinder to force pressurized fluid from said additional cylinder into said second port; means for moving said pistons, comprising a rotary drive member; bearing means for said drive member, said bearing means being disposed in said distributor space; and valve means movably installed in said first passage, said housing having a second passage connecting said second port with said first passage so that the pressurized fluid in said second port and said second passage can move said valve means from a first position in which said valve means permits fluid to flow from said first port into said cylinder and said first port communicates with said additional cylinder by way of said first passage, while the pressure of fluid in said second port is within a first range, to a second position in which said valve means seals said first port from said cylinder while the pressure of fluid in said second port is within a higher second range, and to a third position in which said valve means allows fluid to circulate from said second port to said first port while the pressure of fluid in said second port exceeds said second range.

2. A combination as defined in claim 1, wherein said piston is reciprocable in said cylinder and said valve means is reciprocable between said positions thereof.

3. A combination as defined in claim 1, further comprising a check valve interposed between said cylinder and said second port to prevent the flow of pressurized fluid from said second port into said cylinder.

4. A combination as defined in claim 3, further comprising means for biasing said valve means to said first position thereof.

5. A combination as defined in claim 4, wherein said first passage includes a cylindrical bore and said valve means comprises a valve member which is reciprocable in said bore between said first, second and third positions, said valve member having a first end portion which is acted upon by said biasing means and a second end portion which is acted upon by pressurized fluid in said second passage.

6. A combination as defined in claim 5, wherein said valve member has a first shoulder which seals said first port from said cylinder in said second and third positions of said valve member and a second shoulder which seals said first port from said second passage in said first and second positions of said valve member.

7. A combination as defined in claim 1, wherein said drive member has an eccentric poriton which moves said pistons and further comprising sealing means interposed between said distributor space and said bearing means.

8. In a pump, particularly a radial piston pump, a combination comprising a housing having at least one cylinder, a fluid-admitting first port, a first passage connecting said cylinder with said first port and a second port arranged to discharge pressurized fluid and communicatively connected with said cylinder and a distributor space adapted to communicate with said first space; a piston movable in said cylinder to thereby draw fluid from said first port via said first passage and to force pressurized fluid into said second port; means for moving said piston, comprising a rotary drive member and bearing means for said drive member disposed in said housing and surrounded by said distributor space; and valve means movably installed in said first passage, said housing having a second passage connecting said second port with said first passage so that the pressurized fluid in said second port and said second passage can move said valve means from a first position in which said valve means permits fluid to flow from said first port into said cylinder and into said distributor space, while the pressure of fluid in said second port is within a first range, to a second position in which said valve means seals said first port from said cylinder while the pressure of fluid in said second port is within a higher second range, and to a third position in which said valve means allows fluid to circulate from said second port to said first port while the pressure of fluid in said second port exceeds said second range.

9. A combination as defined in claim 8, wherein said housing has three additional cylinders and further comprising discrete additional pistons in said additional cylinders, said cylinders extending radially outwardly from said moving means and being equally spaced from each other, said third passage including an annular space communicating with said first port by way of said first passage in said first position of said valve means and bores connecting said space with said additional cylinders.

10. A combination as defined in claim 8, wherein said housing has a first bore and said moving means is a drive member rotatably installed in said bore, said third passage including a portion of said bore, said portion of said bore being in communication with said first passage and said third passage further including a second bore connecting said portion of said first bore with said additional cylinder.

11. A combination as defined in claim 8, wherein said piston has an end portion remote from said moving means and sealing said cylinder from said first passage in predetermined positions of said piston with respect to said cylinder.

12. A combination as defined in claim 8, wherein said third passage includes a first bore connecting said additional cylinder with said distributor space, said first passage having a second bore for said valve means and a third bore connecting said second bore with said distributor space to supply to said space fluid from said first port in said first position of said valve means.

* * * * *